US012571548B2

(12) United States Patent
Zhu

(10) Patent No.: US 12,571,548 B2
(45) Date of Patent: Mar. 10, 2026

(54) WATER TANK MODULE FOR AIR-CONDITIONING WATER SYSTEM AND AIR-CONDITIONING WATER SYSTEM

(71) Applicant: Carrier Corporation, Palm Beach Gardens, FL (US)

(72) Inventor: Yu Zhu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 129 days.

(21) Appl. No.: 18/433,549

(22) Filed: Feb. 6, 2024

(65) Prior Publication Data

US 2024/0263811 A1 Aug. 8, 2024

(30) Foreign Application Priority Data

Feb. 8, 2023 (CN) ..... 202310140165.8

(51) Int. Cl.
*F24F 5/00* (2006.01)
*F24F 11/89* (2018.01)

(52) U.S. Cl.
CPC ..... *F24F 5/0003* (2013.01); *F24F 11/89* (2018.01)

(58) Field of Classification Search
CPC ..... F24F 5/0003; F24F 11/89; F24F 13/00
USPC ..... 165/104.31
See application file for complete search history.

(56) References Cited

U.S. PATENT DOCUMENTS 3,384,155 A * 5/1968 Newton ..... F24F 11/84 165/262
4,502,289 A * 3/1985 Kayama ..... F25D 17/02 62/185
4,739,624 A 4/1988 Meckler
5,623,986 A 4/1997 Wiggs
6,991,028 B2 1/2006 Comeaux
8,308,936 B2 11/2012 Numata et al.
(Continued)

FOREIGN PATENT DOCUMENTS

CN 202885245 U 4/2013
CN 203052989 U 7/2013
(Continued)

OTHER PUBLICATIONS

Kaili Mini VWV Frequency Converter Water Multi-connected Home Microclimate Expert, Jun. 22, 2021 https://www.bilibili.com/video/BV1fg411g7yv/.

*Primary Examiner* — Steve S Tanenbaum
(74) *Attorney, Agent, or Firm* — Drew Folgmann

(57) ABSTRACT

A water tank module and an air-conditioning water system configured with the water tank module is disclosed. The air-conditioning water system comprises an outdoor unit, a water pump, an air-conditioning terminal, a leaving water pipe and a return water pipe. The water tank module comprises: a first buffer water tank disposed on the leaving water pipe, where the first buffer water tank is integrated with a first ball valve; and a second buffer water tank disposed on the return water pipe and arranged at or near the first buffer water tank, where the second buffer water tank is integrated with a second ball valve, a safety valve for pressure relief, an exhaust valve for gas exhaust, and a water replenishment valve for water replenishment, wherein, a bypass pipe having a bypass valve is disposed between the first buffer water tank and the second buffer water tank.

16 Claims, 2 Drawing Sheets

(56) References Cited

U.S. PATENT DOCUMENTS

| | | | | |
|---|---|---|---|---|
| 8,997,511 | B2 * | 4/2015 | Berrio | F28D 20/0039 62/235.1 |
| 9,194,594 | B2 | 11/2015 | Liu et al. | |
| 9,885,484 | B2 | 2/2018 | Young et al. | |
| 10,429,090 | B2 | 10/2019 | Usilton | |
| 10,760,823 | B2 | 9/2020 | Knoblett et al. | |
| 11,149,965 | B2 | 10/2021 | Kusachi et al. | |
| 2007/0187521 | A1 | 8/2007 | Wawak | |
| 2010/0170658 | A1 | 7/2010 | Seefeldt et al. | |
| 2012/0304677 | A1 | 12/2012 | Fukunaga et al. | |
| 2019/0353401 | A1 | 11/2019 | Hikone et al. | |
| 2022/0120472 | A1 | 4/2022 | Zhao et al. | |
| 2022/0252277 | A1 | 8/2022 | Berrio | |

FOREIGN PATENT DOCUMENTS

| | | | |
|---|---|---|---|
| CN | 203687253 | U | 7/2014 |
| CN | 205481251 | U | 8/2016 |
| CN | 103868243 | B | 2/2017 |
| CN | 107514815 | A | 12/2017 |
| CN | 207162703 | U | 3/2018 |
| CN | 104515176 | B | 10/2018 |
| CN | 208580945 | U | 3/2019 |
| CN | 209877194 | U | 12/2019 |
| CN | 210951760 | U | 7/2020 |
| CN | 211823145 | U | 10/2020 |
| CN | 115013850 | A | 9/2022 |
| EP | 2282153 | A1 | 2/2011 |
| EP | 3412985 | A1 | 12/2018 |
| EP | 3977019 | A4 | 8/2022 |
| WO | 2021165902 | A1 | 8/2021 |

* cited by examiner

WATER TANK MODULE FOR AIR-CONDITIONING WATER SYSTEM AND AIR-CONDITIONING WATER SYSTEM

CROSS REFERENCE TO RELATED APPLICATIONS

This application claims priority to CN Patent Application No. 202310140165.8 filed on Feb. 8, 2023, which is incorporated by reference herein in its entirety.

FIELD OF THE INVENTION

The disclosure relates to the technical field of water systems, in particular to a water tank module for an air-conditioning water system and an air-conditioning water system configured with the water tank module.

BACKGROUND OF THE INVENTION

The water system of the central air-conditioning system includes a cooling water system and a chilled water/hot water system (generally adopting a single pipe system, circulating chilled water in summer and circulating hot water in winter). In summer, for the chilled water circulation system, it consists of components such as an outdoor unit (cold and heat source), a refrigeration pump, indoor unit(s), and chilled water pipes. The low-temperature chilled water (leaving water) provided from the evaporator of the outdoor unit enters the room through the chilled water (leaving water) pipe for heat exchange, taking away the heat in the room and causing the temperature of the chilled water (return water) to rise, and finally returns to the evaporator of the outdoor unit. Indoor units are used for heat exchange between air and chilled water (coiled pipes), thereby reducing air temperature and accelerating indoor heat exchange. In winter, the hot water (leaving water) provided from the outdoor unit enters the room through the circulating hot water (leaving water) pipe for heat exchange, taking away the cooling capacity in the room and reducing the temperature of the circulating hot water (return water), and finally returns to the outdoor unit. Indoor units are used for heat exchange between air and circulating hot water (coiled pipes), thereby increasing air temperature and accelerating indoor heat exchange.

FIG. 1 shows the chilled water circulation section 10 of an air-conditioning water system provided by the prior art. As shown in the figure, components such as a bypass valve 13, a water tank 14, a safety valve 15, an exhaust valve 16, a water replenishment valve 17, and a pressure gauge 18 etc. are connected in series one by one in a leaving water pipe 11 and a return water pipe 12. Due to the scattered arrangement of the valve components, water tanks, or instrument components in various parts of the air-conditioning water system, there are drawbacks or problems such as inconvenient on-site installation and operation, which cannot meet practical needs well.

SUMMARY OF THE INVENTION

In view of the above, disclosed herein is a water tank module for an air-conditioning water system, so as to solve or at least alleviate one or more of the aforementioned problems and problems in other aspects existing in the prior art, or to provide an alternative technical solution for the prior art.

A water tank module for an air-conditioning water system is provided, wherein the air-conditioning water system comprises an outdoor unit, a water pump, and an air-conditioning terminal, and a leaving water pipe and a return water pipe are provided between the outdoor unit and the air-conditioning terminal, the water tank module comprising:

a first buffer water tank disposed on the leaving water pipe, where the first buffer water tank is integrated with a first ball valve; and a second buffer water tank disposed on the return water pipe and arranged at or near the first buffer water tank, where the second buffer water tank is integrated with a second ball valve, a safety valve for pressure relief, an exhaust valve for gas exhaust, and a water replenishment valve for water replenishment, wherein, a bypass pipe is disposed between the first buffer water tank and the second buffer water tank, and a bypass valve is disposed on the bypass pipe.

Optionally, the first buffer water tank and the second buffer water tank are respectively provided with pressure gauges.

Optionally, the exhaust valve is provided at the top of the second buffer water tank.

Optionally, the first ball valve is provided at the bottom of the first buffer water tank, and the second ball valve is provided at the bottom of the second buffer water tank.

Optionally, the water replenishment valve is provided at the bottom of the second buffer water tank and is connectable to the water pump.

Optionally, the first buffer water tank and the second buffer water tank are of the same size and arranged side by side.

Optionally, the housing of the first buffer water tank and the housing of the second buffer water tank are made of cast iron.

Optionally, the water tank module is configured to include an integrated housing for accommodating the first buffer water tank and the second buffer water tank, and the housing is provided with thermal insulation material.

Optionally, the housing is fastened to a wall at or near the outdoor unit by bolts.

Optionally, the bypass valve is disposed on a connecting pipe at the top of the first buffer water tank and the second buffer water tank.

In addition, an air-conditioning water system is also provided, wherein the air-conditioning water system is configured with the aforementioned water tank module.

It can be appreciated that the water tank module for an air-conditioning water system adopts an integrated design concept, integrating valve units such as safety valves, exhaust valves, ball valves, bypass valves, and water replenishment valves into the water tank module, so that the water tank module not only has the basic functions of buffering and storing chilled water, but also has functions such as safe pressure relief, gas exhaust, water replenishment and bypassing. In addition, the on-site installation of water tank modules by the operating personnel is very efficient and convenient. The entire system installation can be completed by simply connecting the pipes from the outdoor unit and the air-conditioning terminals.

BRIEF DESCRIPTION OF THE DRAWINGS

The technical solution will be described in further detail below in conjunction with the accompanying drawings and embodiments. However, it should be appreciated that these drawings are only designed for explanatory purposes and are merely intended to conceptually illustrate the structural configuration described herein, without the need to be drawn proportionally.

DETAILED DESCRIPTION OF EMBODIMENT(S) OF THE INVENTION

Figure 1:
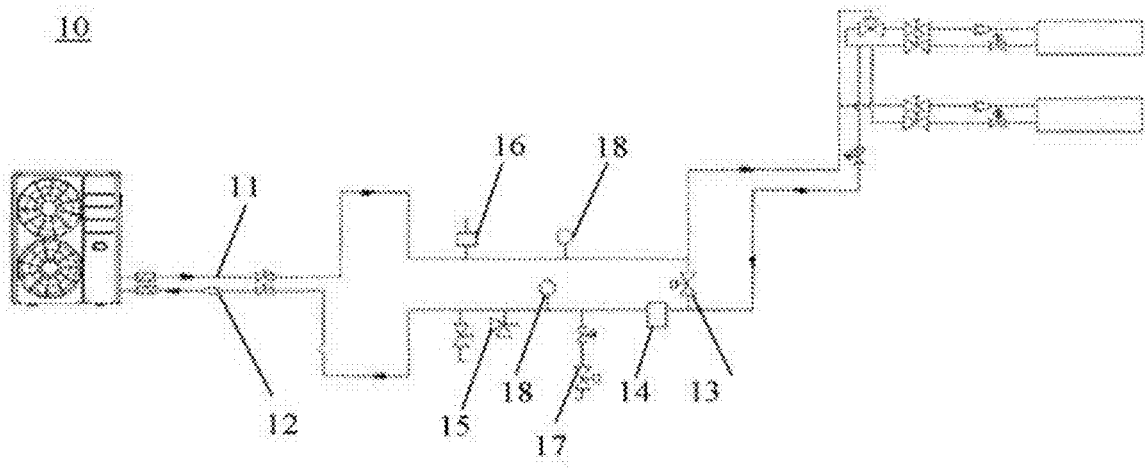
Figure 1 PRIOR ART
FIG. 1 is a simplified schematic diagram illustrating an air-conditioning water system of the prior art.

The content of the invention and the differences between the invention and the prior art can be understood by referring to the accompanying drawings and the text. The technical solution of the invention will be described in further detail below through the accompanying drawings and by enumerating some optional embodiments of the invention.

It should be noted that any technical features or solutions in the embodiments are one or several of multiple optional technical features or technical solutions. For brevity, it is neither possible to exhaustively enumerate herein all alternative technical features and technical solutions of the invention, nor is it possible to emphasize that the implementation of each technical feature is one of the optional multiple implementations. Therefore, those skilled in the art should be aware that any technical means provided by the invention can be substituted, or any two or more technical means or technical features provided by the invention can be combined with each other to obtain a new technical solution.

Any technical feature or technical solution within the embodiments does not limit the scope of protection of the invention. The scope of protection of the invention should include any alternative technical solutions that those skilled in the art can think of without creative labor, as well as any new technical solutions obtained by those skilled in the art by combining any two or more technical means or technical features provided by the invention.

With the development of technology, water systems need to be applied to various fields in life and industry, such as to air-conditioning water systems used in the field of air-conditioning. Those skilled in the art are already aware that the air-conditioning water system is the core system connecting the cold and hot supply side with the air-conditioning consumer side. On the one hand, the air-conditioning water system needs to be regulated to meet the demand for air-conditioning water volume and heat of multiple air-conditioning terminal consumer sides under different working conditions, which is thermal balance. On the other hand, the main power components of the air conditioner need to overcome the resistance from, for example, pipes and valves of the system, and transport the cold or hot water prepared by the air-conditioning source to each air-conditioning terminal. However, it should be pointed out that the aforementioned valves are usually arranged in a scattered manner at various locations of the leaving water pipe and the return water pipe of the air-conditioning water system, which makes on-site installation very inconvenient to the operating personnel.

In order to solve the aforementioned technical problem, a water tank module for an air-conditioning water system is provided. In order to better understand the technical solution, the water tank module for an air-conditioning water system according to some embodiments will be described in detail below in conjunction with the accompanying drawings.

Figure 2:
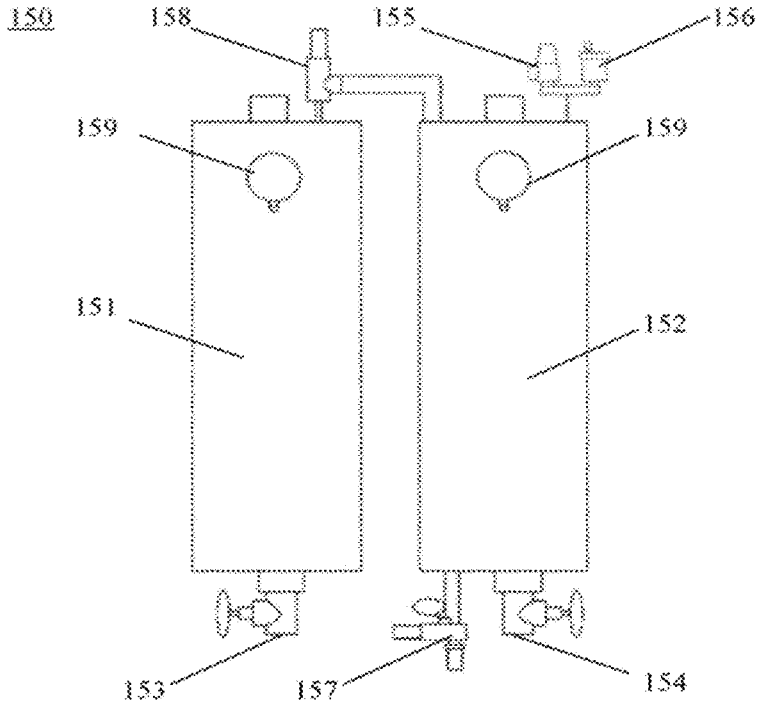
FIG. 2 is a schematic diagram illustrating the composition and structure of an embodiment of a water tank module for an air-conditioning water system according to the present invention.

FIG. 2 schematically illustrates the structure of an embodiment of a water tank module for an air-conditioning water system in general. As can be clearly seen from FIGS. 2 and 3, the air-conditioning water system 100 has an outdoor unit 110, a water pump (not shown), and air-conditioning terminals 120. A leaving water pipe 130 and a return water pipe 140 are provided between the outdoor unit 110 and the air-conditioning terminals 120. The water tank module 150 includes a first buffer water tank 151 and a second buffer water tank 152. The first buffer water tank 151 (i.e., the leaving water buffer water tank) is arranged on the leaving water pipe 130, where the first buffer water tank 151 is integrated with a first ball valve 153. The second buffer water tank 152 (i.e., the return water buffer water tank) is arranged on the return water pipe 140 and is disposed at or near the first buffer water tank 151, where the second buffer water tank 152 is integrated with a second ball valve 154, a safety valve 155 for pressure relief (once the system pressure is detected to be too high, the safety valve is turned on to spray out the chilled water), an exhaust valve 156 for gas exhaust, and a water replenishment valve 157 for water replenishment. A bypass pipe is provided between the first buffer water tank 151 and the second buffer water tank 152, and a bypass valve 158 is provided on the bypass pipe. The bypass valve 158 has a set pressure value. Once the difference between the leaving water pressure and the return water pressure exceeds the set pressure value, the bypass valve 158 will be automatically turned on, so as to allow a portion of the water flow to flow from the bypass pipe to the outdoor unit 110, thereby ensuring that the outdoor unit has sufficient chilled water flow.

As can be seen from the above, the water tank module for an air-conditioning water system is integrated with different types of valves such as safety valves, exhaust valves, ball valves, bypass valves, and water replenishment valves. Therefore, in addition to the functions of buffering and storing chilled water, the water tank module also has various functions such as safe pressure relief, gas exhaust, water replenishment, and bypassing. In addition, the water tank module can significantly improve the efficiency of on-site installation. As long as the pipes from the outdoor unit and those from the air-conditioning terminals are connected, the overall installation can be completed, thus simplifying the installation process.

In combination with the above embodiments, in other optional embodiments, the first buffer water tank 151 and the second buffer water tank 152 are respectively provided with pressure gauges 159. The pressure gauges 159 can clearly display the leaving water pressure value of the leaving water pipe 130 and the return water pressure value of the return water pipe 140, thus allowing the operating personnel to learn the on/off status of the bypass valve through the current return water and leaving water conditions. In addition, in order to facilitate more water volume to join in the bypass cycle, the bypass valve 158 can be arranged on the connecting pipe at the top of the first buffer water tank 151 and the second buffer water tank 152.

Considering that the return water pipe 140 of the air-conditioning water system 100 often contains some gases, where these gases will easily accumulate at the top of the second buffer water tank 152, leading to the formation of gasbags, and in severe cases, even gas resistance problems, which will result in unstable pressure in the air-conditioning water system 100. To avoid this from happening, the exhaust valve 156 can be arranged at the top of the second buffer water tank 152 to exhaust the gas contained in the air-conditioning water system 100. As shown in FIG. 2, in order to smoothly spray out chilled water when turning on the safety valve 155 and at the same time avoid the sprayed chilled water from coming into contact with other devices, the safety valve 155 can be arranged at the top of the second buffer water tank 152. In addition, the first ball valve 153 can be arranged at the bottom of the first buffer water tank 151, and the second ball valve 154 can be arranged at the bottom of the second buffer water tank 152, so as to cut off the water circuit during maintenance and store chilled water in the first buffer water tank 151 and the second buffer water tank 152. Furthermore, the water replenishment valve 157 can be arranged at the bottom of the second buffer water tank 152 and is connectable to the water pump.

Figure 3:
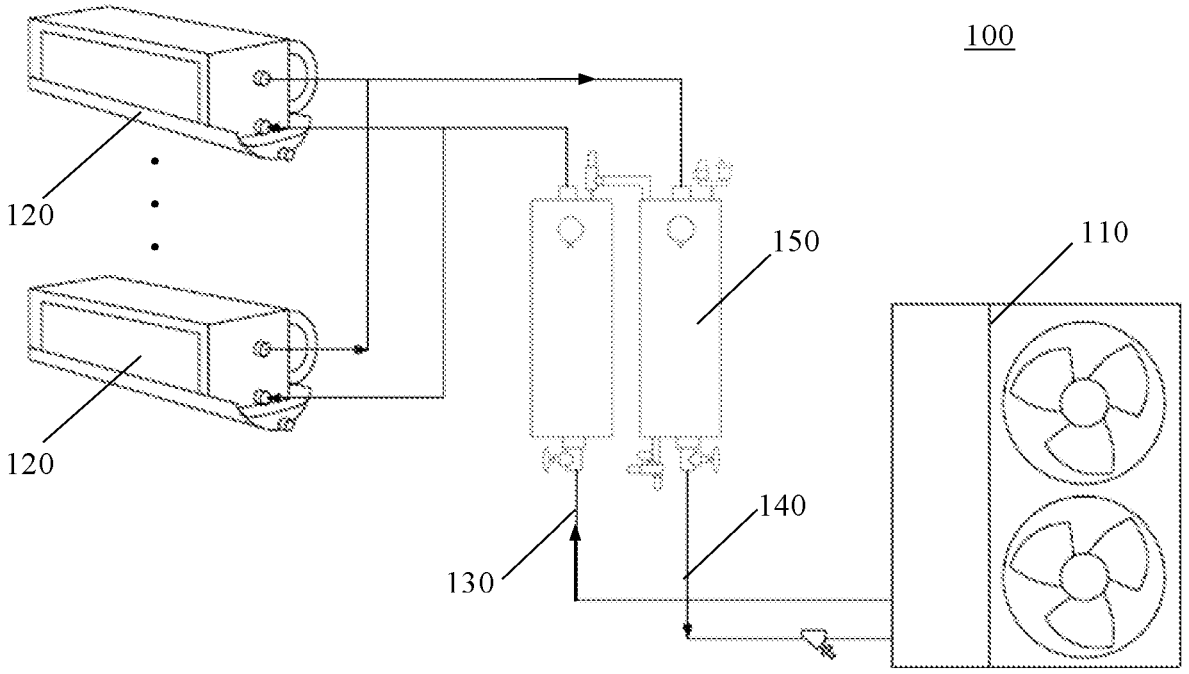
FIG. 3 is a simplified schematic diagram of an air-conditioning water system configured with the water tank module shown in FIG. 2.

With continued reference to FIGS. 2 and 3, the first buffer water tank 151 and the second buffer water tank 152 can be designed to be of the same size and arranged side by side to form a compact overall structure. In addition, to make it easy for manufacture, the housing of the first buffer water tank 151 and that of the second buffer water tank 152 can be made of cast iron. As an alternative solution, the water tank module 100 can also be constructed to include an integrated housing (not shown) for accommodating the first buffer water tank 151 and the second buffer water tank 152, and the housing is provided with thermal insulation material, such as expanded polypropylene (EPP), to ensure thermal insulation and airtightness of the first buffer water tank 151 and the second buffer water tank 152. It is readily appreciated that the size, shape, location, and installation method of the housing can be designed according to actual manufacture needs, where no specific limitations are provided in this regard. For example, the housing can be secured to a wall at or near the outdoor unit by bolts with the help of a backboard.

In addition, an air-conditioning water system configured with the aforementioned water tank module is also disclosed. As mentioned earlier, an air-conditioning water system configured with the aforementioned water tank module can effectively improve the overall installation efficiency.

To sum up, the water tank module for an air-conditioning water system adopts an integrated design concept. Specifically, the safety valve, exhaust valve, ball valve, bypass valve, and water replenishment valve are integrated into the water tank module, so that the water tank module not only has the functions of buffering and storing chilled water, but also has functions such as safe pressure relief, gas exhaust, water replenishment, and bypassing. In addition, the on-site installation of the water tank module is very efficient and convenient, as the entire system installation can be completed by simply connecting the pipes from the outdoor unit with the pipes of the air-conditioning terminals. Therefore, it is highly recommended to apply the aforementioned water tank module to various air-conditioning water systems.

If terms such as "first" and "second" are used herein to limit components, those skilled in the art should be aware that the use of "first" and "second" is only for the convenience of describing and distinguishing components. Unless otherwise stated, the above terms do not have any special meanings.

Meanwhile, if the above invention discloses or relates to components or structural components that are fixedly connected to each other, unless otherwise stated, fixed connections can be understood as fixed connections in a detachable manner (such as connections using bolts or screws), or as fixed connections in a non-detachable manner (such as through riveting, welding). Of course, fixed connections to each other can also be replaced by integrated structures (such as those manufactured into one piece using casting technology), except that when it is evidently impossible to use the integration process.

In addition, as to the terms used to indicate positional relationships or shapes in any of the technical solutions disclosed in the invention, unless otherwise stated, the implications thereof include states or shapes that are approximate, similar, or close to them. Any component provided by the invention can be either assembled from multiple individual components or manufactured as a separate component using an integration process.

If terms such as "center", "longitudinal", "transverse", "front", "back", "left", "right", "vertical", "horizontal", "top", "bottom", "inside", "outside", etc. are used in the depiction of the invention, the orientations or positional relationships indicated by the above terms are based on the orientations or positional relationships shown in the drawings. These terms are used merely for the convenience of describing the invention and simplifying the description, rather than indicating or implying that the device, mechanism, component or element referred to must have a specific orientation, be constructed and operated in a specific orientation, so they cannot be understood as forming limitations on the scope of protection of the invention.

Last, it should be noted that the above embodiments are only used to illustrate the technical solution of the invention but not to limit it. Although the invention has been described in detail with reference to preferred embodiments, those skilled in the art, however, should understand that the specific embodiments of the invention can still be modified or some technical features can be equivalently substituted. Without departing from the spirit of the technical solution of the invention, all of these modified embodiments or technical features used for equivalent substitution should fall within the scope of the claimed technical solution of the invention.

What is claimed is:

1. A water tank module for an air-conditioning water system, wherein the air-conditioning water system comprises an outdoor unit, a water pump, and an air-conditioning terminal, and a leaving water pipe and a return water pipe are provided between the outdoor unit and the air-conditioning terminal, the water tank module comprising:

a first buffer water tank disposed on the leaving water pipe, where the first buffer water tank is integrated with a first ball valve;

a second buffer water tank disposed on the return water pipe and arranged at or near the first buffer water tank, where the second buffer water tank is integrated with a second ball valve, a safety valve for pressure relief, an exhaust valve for gas exhaust, and a water replenishment valve for water replenishment, wherein the water tank module is constructed to include an integrated housing for accommodating the first buffer water tank and the second buffer water tank; and wherein, a bypass pipe is disposed between the first buffer water tank and the second buffer water tank, and a bypass valve is disposed on the bypass pipe.

2. The water tank module for an air-conditioning water system according to claim 1, wherein the first ball valve is provided at the bottom of the first buffer water tank, and the second ball valve is provided at the bottom of the second buffer water tank.

3. The water tank module for an air-conditioning water system according to claim 1, wherein the water replenishment valve is provided at the bottom of the second buffer water tank and is connectable to the water pump.

4. The water tank module for an air-conditioning water system according to claim 1, wherein the first buffer water tank and the second buffer water tank are of the same size and arranged side by side.

5. The water tank module for an air-conditioning water system according to claim 1, wherein housing of the first buffer water tank and housing of the second buffer water tank are made of cast iron.

6. The water tank module for an air-conditioning water system according to claim 1, wherein the bypass valve is disposed on a connecting pipe at the top of the first buffer water tank and the second buffer water tank.

7. An air-conditioning water system, wherein the air-conditioning water system is configured with the water tank module according to claim 1.

8. The water tank module for an air-conditioning water system according to claim 1, wherein the first buffer water tank and the second buffer water tank are respectively provided with pressure gauges.

9. The water tank module for an air-conditioning water system according to claim 8, wherein the exhaust valve is provided at the top of the second buffer water tank.

10. The water tank module for an air-conditioning water system according to claim 1, wherein the housing is provided with thermal insulation material.

11. The water tank module for an air-conditioning water system according to claim 10, wherein the housing is fastened to a wall at or near the outdoor unit by bolts.

12. A water tank module for an air-conditioning water system, wherein the air-conditioning water system comprises an outdoor unit, a water pump, and an air-conditioning terminal, and a leaving water pipe and a return water pipe provided between the outdoor unit and the air-conditioning terminal, the water tank module comprising:

a first buffer water tank disposed on the leaving water pipe;

a second buffer water tank disposed on the return water pipe and arranged at or near the first buffer water tank; and wherein the water tank module is constructed to include an integrated housing for accommodating the first buffer water tank and the second buffer water tank.

13. The water tank module according to claim 12, wherein the housing is provided with thermal insulation material.

14. The water tank module according to claim 12, wherein the housing is fastened to a wall at or near the outdoor unit by bolts.

15. The water tank module according to claim 12, further comprising a bypass pipe disposed between the first buffer water tank and the second buffer water tank.

16. The water tank module according to claim 15, further comprising a bypass valve disposed on the bypass pipe.

* * * * *